US006790015B1

(12) United States Patent
Song

(10) Patent No.: US 6,790,015 B1
(45) Date of Patent: Sep. 14, 2004

(54) PISTON SUPPORTING STRUCTURE FOR LINEAR COMPRESSOR

(75) Inventor: Gye Young Song, Kyungki-Do (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/914,055

(22) PCT Filed: Dec. 21, 1999

(86) PCT No.: PCT/KR99/00794

§ 371 (c)(1),
(2), (4) Date: Jan. 16, 2002

(87) PCT Pub. No.: WO01/50020

PCT Pub. Date: Jul. 12, 2001

(51) Int. Cl.[7] ..... F04B 17/04; F04B 35/04
(52) U.S. Cl. ..... 417/417; 417/415
(58) Field of Search ..... 417/417, 415, 417/416, 570

(56) References Cited

FOREIGN PATENT DOCUMENTS

| | | |
|---|---|---|
| JP | 56-13557 | 2/1981 |
| JP | 56129780 | 10/1981 |
| JP | 59-218369 | 12/1984 |
| JP | 97-11394 | 3/1997 |

*Primary Examiner*—Justin R. Lu
*Assistant Examiner*—William H. Rodriguez
(74) *Attorney, Agent, or Firm*—Ostrolenk, Faber, Gerb & Soffen, LLP

(57) ABSTRACT

A piston supporting structure for a linear compressor includes a piston reciprocating in the axial direction in response to the driving force of a motor, a first spring of which one end portion is fixed to one side of the piston, and a second spring of which one end portion is fixed to the other side of the piston. The first and second springs elastically supporting the piston reciprocating in response to the driving force of the motor are contracted and relaxed in the axial direction without being displayed in a radial direction, and thereby elastically support the reciprocating movement of the piston, so that the piston can linearly reciprocate in the axial direction in the compressing space of the cylinder. Accordingly, a rotation movement is not applied to the piston, thereby preventing the abrasion of the piston and cylinder and the breakage of parts.

3 Claims, 4 Drawing Sheets

PISTON SUPPORTING STRUCTURE FOR LINEAR COMPRESSOR

TECHNICAL FIELD

The present invention relates to a piston supporting structure for a linear compressor, and in particular to a piston supporting structure for a linear compressor in which a spring elastically supporting a piston supports the piston, being only axially contracted and relaxed by the reciprocating movement of the piston in receipt of driving force of a motor, While not being displaced in a radial direction.

BACKGROUND ART

Generally, a compressor constituting a refrigerating cycle apparatus compresses refrigerant introduced from an evaporator and discharges the same to a high temperature and pressure state.

A linear compressor, an example of the above-described compressor, inducts refrigerant gas and compresses the same by driving force of a motor transferred to a piston reciprocating in a cylinder. At this time, the piston is elastically:supported by springs at both sides thereof, and the kinetic energy thereof is stored.

As illustrated in FIG. 1, the above-described linear compressor includes a closed vessel 1 formed to have predetermined inner space, an inner case 2 installed at the inner center portion of the closed vessel 1 and formed to have a predetermined inner space, a cover plate 3 for covering and opening one side of the inner case 2, a cylinder 4 connected to the cover plate 3 so as to be positioned at the inner portion of the inner case 2, an outer lamination 5 connected to the inner side of the inner case 2, an inner lamination 6 connected to the cylinder at a predetermined distance from the outer lamination 5, a magnet 7 inserted between the inner lamination 5 and the outer lamination 6 thereby to construct a motor including them, a piston 8 connected to a cylindrical compression space (P) formed at the inner portion of the cylinder 4 to be reciprocatingly movable, a connecting member 9 formed in a predetermined shape with its one side being connected to the magnet 7 and the other side being connected to one side of the piston 8 for thereby transferring driving force of the motor to the piston 8, a cover 10 for covering and opening the other side of the inner case 2, an inner spring 11 connected between the connecting member 9 and the inner lamination 6, and an outer springs 12 connected between the connecting member 9 and the cover 10.

The inner spring 11 and the outer spring 12 are usually round coil springs.

In addition, a valve assembly 13 for inducting refrigerant gas into the cylinder 4 and discharging compressed refrigerant gas to the outside of the cylinder 4 and a head cover 14 are connected to one side of the cylinder 4.

Unexplained reference numerals 15 and 16 in FIG. 5 each represents a winding coil and an oil feeder.

Hereinafter, the operation of the conventional linear compressor thus constructed will now be described.

When a current is applied to the motor, the magnet 7 linearly reciprocates. The linear reciprocating movement of the magnet 7 is transferred to the piston by the connecting member 9, and thereby the piston 8 reciprocates in the compression space (P) of the cylinder.

In this manner, as the piston 8 reciprocates in the compression space (P) of the cylinder 4 refrigerant gas induced into the closed vessel 1 is inducted into the compression space (P) of the cylinder 4 through a refrigerant inlet passage (F), compressed and discharged to the outside of the cylinder through the valve assembly 13 and the head cover 14 repeatedly.

At this time, the piston 8 is elastically supported by the inner and outer springs 11 and 12 positioned at both sides of the piston 8, while storing and discharging kinetic energy. Hereinafter, the example of the piston supporting structure for the conventional linear compressor of the inner and outer springs 11 and 12 supporting the piston 8 will now be described.

As illustrated in FIG. 2, a first supporting plate 17 including a disc unit 17*a* having a predetermined thickness and a circumferential unit 17*b* vertically curved and extended to have an inner diameter corresponding to the outer diameter of the outer spring 12 at the circumferential portion of the disc unit 17*a* is connected to the inner side of the cover 10.

In addition, a second supporting plate 18 including a disc unit 18*a* having a predetermined thickness and a circumferential unit 18 vertically curved and extended to have an inner diameter larger than the outer diameter of the outer spring 12 at the circumferential portion of the disc unit 18*a* is connected to the outer side of the connecting member 9 so that it is opposed to the first supporting plate 17.

In addition, a third supporting plate 19 including a disc unit 19*a* having, a predetermined thickness and a circumferential unit 19*b* vertically curved and extended to have an inner diameter larger than the outer diameter of the inner spring 11 at the circumferential portion of the disc unit 19*a* is connected to the inner side of the connecting member.

In addition, a fourth supporting plate 20 including a disc unit 20*a* having a predetermined thickness and a circumferential unit 20*b* vertically curved and extended to have an inner diameter larger than the outer diameter of the inner spring 11 at the circumferential portion of the disc unit 20*a* is connected to the outer side of the inner lamination 6 so that it is opposed to the third supporting plate 19.

The outer spring 12 is connected between the first and second supporting plates 17 and 18 thus connected, and the inner spring 1 is connected between the third and fourth supporting plates 19 and 20.

In detail, one end portion of the outer spring 12 is fixedly connected to the first supporting plate 17, and the other end portion is loosely 20 supported by the second supporting plate 18.

In addition, one end portion of the inner spring 11 is loosely supported by the third supporting plate 19, and the other end portion is fixedly connected to the fourth supporting plate 20.

Therefore, when the piston 8 reciprocates by driving force of the motor transferred to the piston 8 by the connecting member 9, the outer spring 12 and the inner spring 11, as illustrated in FIG. 3, are positioned linearly in the axial direction, and then elastically support the movement of the piston 8 while repeatedly being contracted and relaxed and store and discharge kinetic energy into elastic energy at the same time.

FIG. 3 and FIG. 4 to be explained below illustrate only the operation of the inner spring 11.

However, in the conventional linear motor described above, when the inner and outer springs 11 and 12 for elastically supporting the piston reciprocating in the compression space (P) of the cylinder in receipt of driving force of the motor by the connecting member 9 are contracted and relaxed in the axial direction, the inner and outer springs 11 and 12 each supported by the second supporting plate 18 and the third supporting plate 19 connected to the connecting member 9 connected to the piston 8 are loosely supported. Therefore, as illustrated in FIG. 4, when the inner and outer springs 11 and 12 are contracted and relaxed in the axial direction, an eccentricity is generated in a radius direction. Then, as illustrated in FIG. 5, an angular moment due to $F_3$ and $F_b$ which are in the reciprocal directions is applied to the piston 8 by the eccentricity of the spring. Subsequently, there arises a problem that an abrasion is generated by the friction between the outer circumferential side of the piston reciprocating in the compression space (P) of the cylinder 4 and the inner circumferential side of the cylinder 4.

TECHNICAL PROBLEMS TO BE OVERCOME IN THE PRESENT INVENTION

Therefore, it is an object of the present invention to provide a piston supporting structure for an linear compressor in which a spring elastically supporting a piston supports the piston, being only axially contracted and relaxed by the reciprocating movement of the piston in receipt of driving force of a motor, while not being displaced in a radial direction, thereby preventing an abrasion of the piston and cylinder and increasing the compressing efficiency of the compressor.

DISCLOSURE OF THE INVENTION

In order to achieve the above-described objects of the present invention, there is provided a piston supporting structure for an linear compressor including: a piston reciprocating in the axial direction in receipt of driving force of a motor; a first spring of which one end portion is fixed to one side of the piston; and a second spring of which one end portion is fixed to the other side of the piston.

MODES FOR CARRYING OUT THE PREFERRED EMBODIMENTS

Hereinafter, the preferred embodiment of the present invention will now be described with reference to the accompanying drawings.

Figure 1:
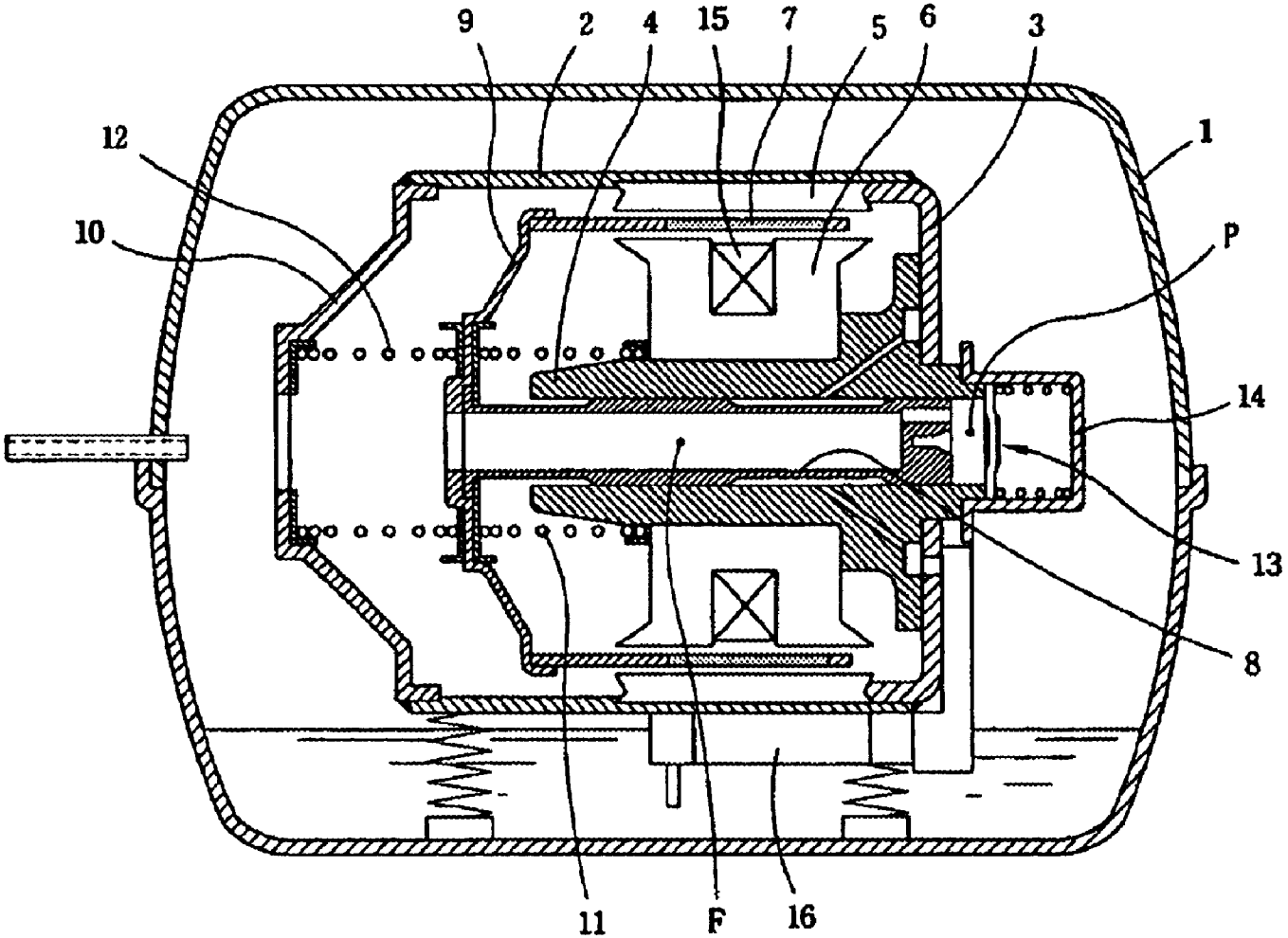
FIG. 1 PRIOR ART
FIG. 1 is a diagram illustrating an example of a general linear compressor.
Figure 2:
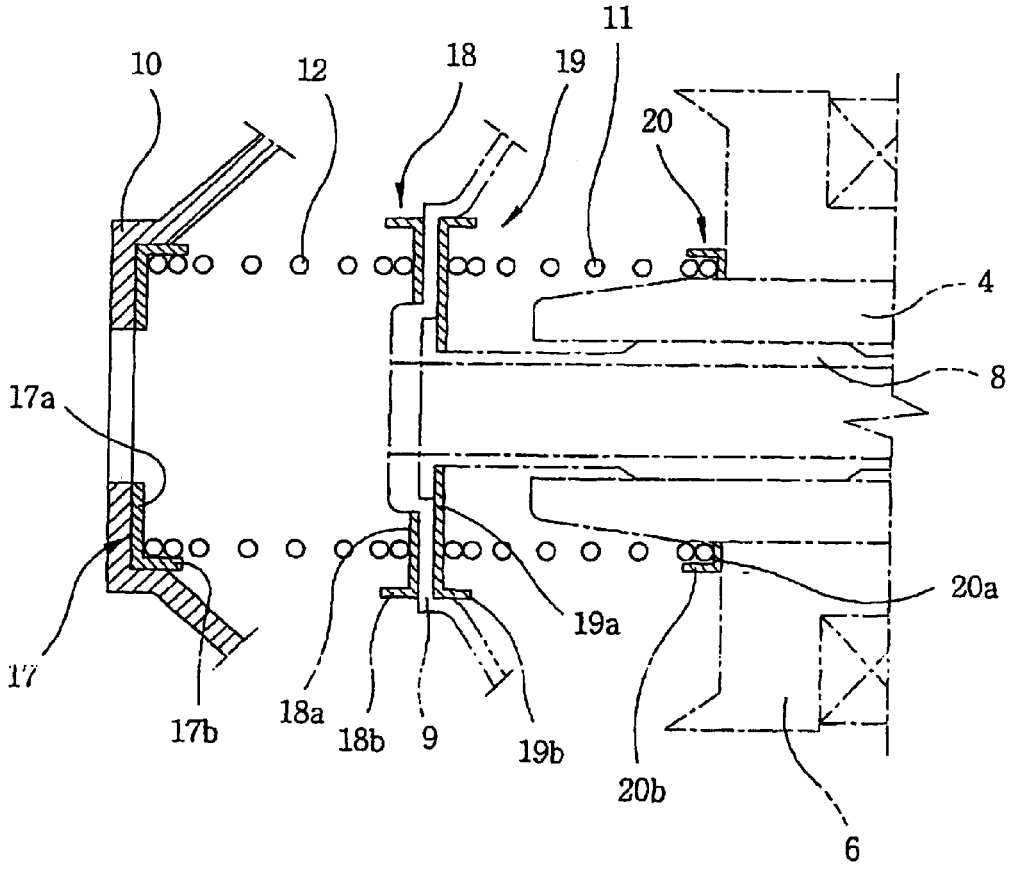
FIG. 2 PRIOR ART
FIG. 2 is a cross-sectional view illustrating an example of a piston supporting structure of a linear compressor in the conventionl art.
Figure 3:
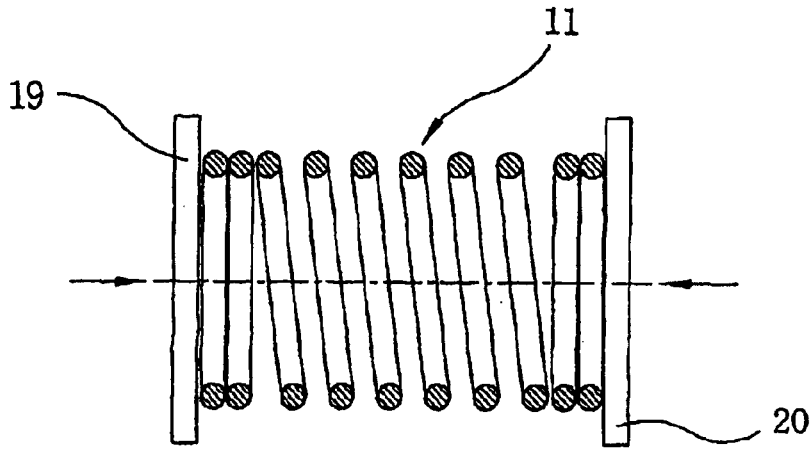
FIG. 3 PRIOR ART
FIG. 3 is a cross-sectional view illustrating the state of a spring prior to the operation of a linear compressor in a piston supporting structure for a linear compressor in accordance with the conventional art.
Figure 4:
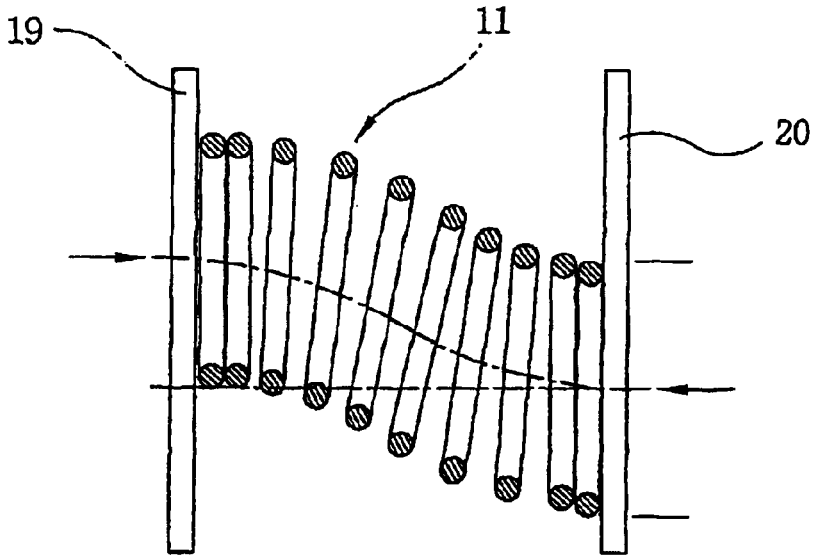
FIG. 4 PRIOR ART
FIG. 4 is a cross-sectional view illustrating the state of a spring during the operation of a linear compressor in a piston supporting structure for a linear compressor in accordance with the conventional art.
Figure 5:
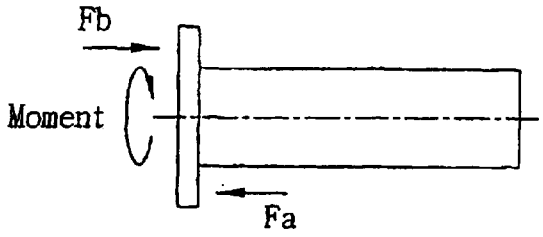
FIG. 5 PRIOR ART
FIG. 5 is a schematic diagram illustrating the state of a moment being applied to a piston by the eccentricity of the spring in a piston supporting structure for a linear compressor in accordance with the conventional art.

In the drawings, like reference numerals designate like composing elements illustrated in FIGS. 1 and 2. Thus, the description of such composing elements may be omitted herein.

Figure 6:
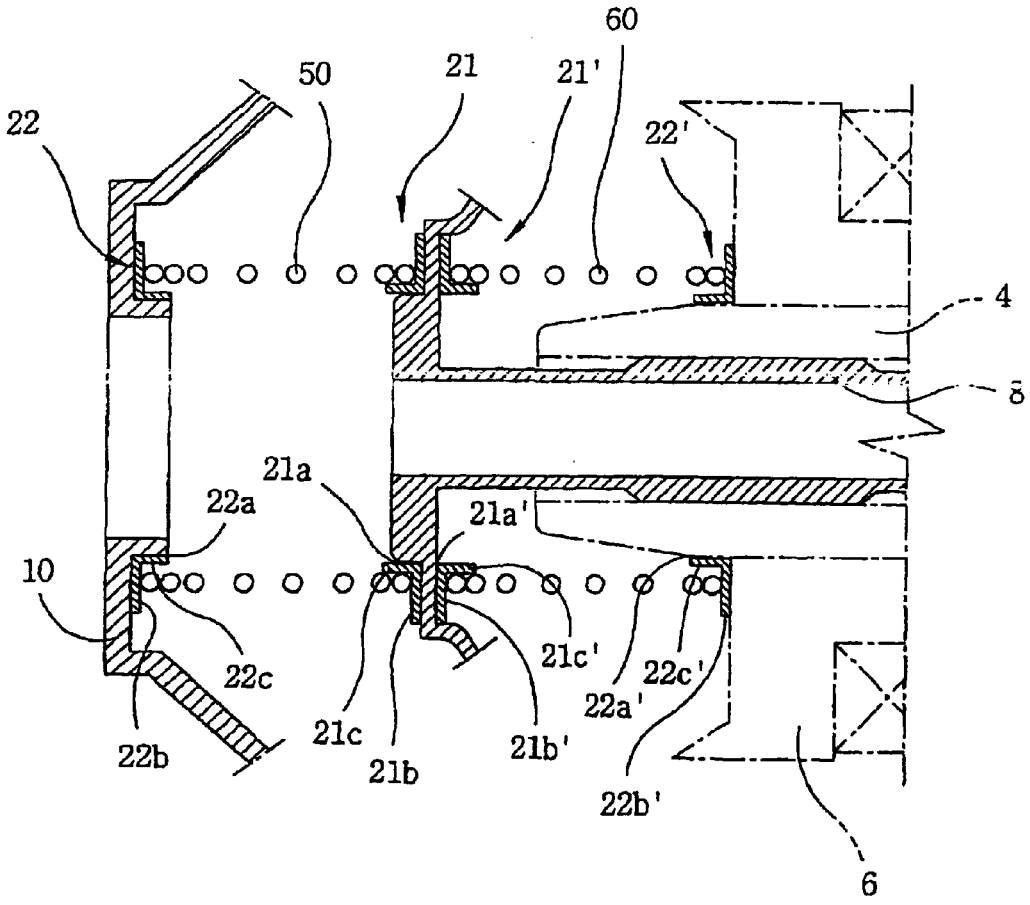
FIG. 6 is a cross-sectional view illustrating a piston supporting structure for a linear compressor in accordance with the present invention.

Firstly, a piston supporting structure for a linear compressor in accordance with the present invention, as illustrated in FIG. 6, includes: a piston 8 reciprocating in the axial direction in receipt of driving force of a motor, a first spring 50 of which one end portion is fixed to one side of the piston and of which the other end portion is supported by the inner side of a cover 10; and a second spring 60 of which one end portion is fixed to the 7. other side of the piston 8 and of which the other end portion is supported by the outer side of an inner lamination 6.

The reciprocating movement of the piston 8 is elastically supported by the contraction and relaxation of the first and second springs 50 and 60 in the axial direction.

The first and second springs 50 and 60 are round coil springs, of which standards are preferably the same.

Hereinafter, the piston supporting structure for the linear compressor in accordance with the present invention will now be described in detail.

Spring fixing supporting members 21 and 21' having a predetermined shape each are fixedly connected to both sides of the piston 8, and one end portions of the first spring 50 and second spring 60 each are fixedly connected to the spring fixing supporting members 21 and 21'.

The spring fixing supporting members 21 and 21' are formed in a hollow disc shape having a certain thickness and a predetermined diameter. The structure of which is characterized in that ring units 21*b* and 21*b'* provided with through holes 21*a* and 21*a'* having a predetermined diameter are formed at the center, and circumferential units 21*c* and 21*c'* vertically curved and extended in order to have a predetermined height thereby to have an outer diameter corresponding to the inner diameter of the first and second springs 50 and 60 are formed at the circumferential portions of the through holes 21*a* and 21*a'* of the ring units 21*b* and 21*b'*:

Meanwhile, the other end portions of the first spring 50 and second spring 60 each are loosely supported by the spring fixing supporting members 22 and 22' each fixedly connected to the inner side of the cover 10 and the outer side of the inner lamination 6 positioned at a predetermined distance from both sides of the piston 8.

The spring fixing supporting members 22 and 22' are formed in a hollow shape having a certain thickness and a predetermined diameter. The structure of which is characterized in that ring units 22*b* and 22*b'* provided with through holes 22*a* and 22*a'* having a predetermined diameter are formed at the center, and circumferential units 22*c* and 22*c'* vertically curved and extended in order to have a predetermined height thereby to have an outer diameter larger than the inner diameter of the first and second springs 50 and 60 are formed at the circumferential portions of the through holes 22*a* and 22*a'* of the ring units.

Therefore, the piston supporting structure for the linear compressor in accordance with the present invention is characterized in detail in that one end portion of the first spring 50 is fixedly inserted into the circumferential portion 21*c* of the spring fixing supporting member 21 connected to the outer side of the piston 8, and the other end portion is loosely inserted into the circumferential portion 22*c* of the spring fixing supporting member 22 connected to the cover 10.

Likewise, one end portion of the second spring 60 is fixedly inserted into the circumferential portion 21*c'* of the spring fixing supporting member 21' connected to the outer side of the piston 8, and the other end portion is loosely inserted into the circumferential portion 22*c*' of the spring fixing supporting member 22' connected to the inner lamination 6.

Hereinafter, the operation and effects of the piston supporting structure for the linear compressor in accordance with the present invention will be described.

Firstly, when the piston 8 reciprocates by driving force of the motor transferred to the piston 8 by the connecting member 9, the outer spring 12 and the inner spring 11 elastically support the movement of the piston 8 while repeatedly being contracted and relaxed, and store and discharge kinetic energy into elastic energy at the same time.

At this time, one of both end portions of the first and second springs 50 and 60 elastically supporting the piston 8 reciprocating as described above is loosely supported, while one end portion in contact with the piston 8 is contracted and relaxed, being fixed to the piston and reciprocating as a single body mated with the piston 8, and thereby elastically supports the piston. Thus, the first and second springs 50 and 60 are not displaced in a radius direction.

That is, since the first and second springs 50 and 60 are contracted and relaxed in the axial direction without being displaced in a radius direction and thereby elastically support the reciprocating movement of the piston 8, the piston linearly reciprocates only in the axial direction without being displaced in a radius direction when it moves in the compression space (P) of the cylinder 4. Subsequently, the abrasion of the piston 8 and the cylinder 4 is prevented.

INDUSTRIAL AVAILABILITY

In the piston supporting structure for the linear compressor in accordance with the present invention, the first and second springs elastically supporting the piston reciprocating in receipt of driving force of the motor are contracted and relaxed in the axial direction without being displaced in a radius direction, and thereby elastically support the reciprocating movement of the piston, so that the piston can linearly reciprocate in the axial direction in the compression space of the cylinder. Accordingly, a rotation moment is not applied to the piston, thereby preventing the abrasion of the piston and cylinder and the breakage of parts.

In addition, driving force of the motor serves as a suction force and a compression force without a loss due to friction, thereby increasing the compression efficiency of the compressor.

What is claimed:

1. A piston supporting structure for a linear compressor, the linear compressor including a cylinder, a piston reciprocating in an axial direction of the cylinder, an inner lamination fixed on a circumference of the cylinder, a cover member placed at a distance from the piston, a first spring disposed between the cover member and the piston, a second spring disposed between the piston and the inner lamination, comprising:

a first spring support member fixed on the cover member and formed of a ring shaped plate on which an end of the first spring is supported to be movable in a radial direction of the first spring;

a second spring support member fixed on one side of the piston, the second spring support member having a ring shaped plate portion on which another end of the first spring is supported and a circumferential unit extending from an inner circumference of the ring shaped plate portion toward the cover member in the axial direction of the piston for being fixed with an inner circumference of the first spring;

a third spring support member fixed on an opposite side of the piston on which the second spring support member is fixed, the third spring support member having a ring shaped plate portion on which an end of the second spring is supported and a circumferential unit extending from an inner circumference of the ring shaped plate portion toward the lamination in an axial direction of the piston for being fixed with an inner circumference of the second spring; and a fourth spring support member fixed on the inner lamination and formed of a ring shaped plate on which another end of the second spring is supported to be movable in a radial direction of the second spring.

2. The piston supporting structure according to claim 1, wherein the first spring support member comprises:

a ring shaped plate portion formed of a flat surface perpendicular to the first spring for allowing radial movement of the first spring; and a circumferential unit extending from an inner circumference of the ring shaped plate portion in an axial direction of the piston at a distance from the inner circumference of the first spring for limiting a radial movement of the first spring.

3. The piston supporting structure according to claim 1, wherein the fourth spring support member comprises:

a ring shaped plate portion formed of a flat surface perpendicular to the second spring for allowing a radial movement of the second spring; and a circumferential unit extended from an inner circumference of the ring shaped plate portion in an axial direction of the piston at a distance from the inner circumference of the second spring for limiting radial movement of the second spring.

* * * * *